United States Patent [19]

Bühler

[11] Patent Number: 4,615,035

[45] Date of Patent: Sep. 30, 1986

[54] BOTTOM ELECTRODE ARRANGEMENT FOR AN ELECTRIC FURNACE

[75] Inventor: Karl Bühler, Nussbaumen, Switzerland

[73] Assignee: BBC Brown, Boveri & Company Limited, Baden, Switzerland

[21] Appl. No.: 694,313

[22] Filed: Jan. 24, 1985

[30] Foreign Application Priority Data

Jan. 31, 1984 [CH] Switzerland ..... 444/84

[51] Int. Cl.[4] ..... H05B 7/02

[52] U.S. Cl. ..... 373/72

[58] Field of Search ..... 373/72, 108, 107, 45, 373/41, 36, 30

[56] References Cited

U.S. PATENT DOCUMENTS 1,167,176 1/1916 Highfield ..... 373/72

4,125,737 11/1978 Andersson ..... 373/108

*Primary Examiner*—Roy N. Envall, Jr.

*Attorney, Agent, or Firm*—Oblon, Fisher, Spivak, McClelland & Maier

[57] ABSTRACT

The shape of the furnace hearth (20) in the area of the bottom electrode (6) is defined within limits given by exponential functions, with minimum and maximum values being given for the ratio of the cross section ($A_L$) of the of the melting bath (13) to the cross section (A) of the bottom electrode (6) in its melting bath contact surface (6', 7'). The electrode is designed in the shape of a truncated cone, with the cone surface enclosing an angle of at least 20° with the melting bath contact surface. The trumpet-shaped or conical widening of the furnace hearth surface (20) in the area of the bottom electrode makes possible a continuous transition of the current and of the electromagnetic field in this area, by which means the bath movement near to the melting bath contact surface (6', 7') of the bottom electrode (6) is also reduced. The arrangement of the bottom electrode (4) in a protuberance of the furnace hearth (20) protects the bottom electrode (6) from the flow spreading throughout the entire melting bath (13). Moreover, only one metal sump is required in the protuberance in order to initiate a subsequent melting process, and not, as in normal practice, a metal sump which extends over the entire furnace hearth surface (20).

11 Claims, 9 Drawing Figures

BOTTOM ELECTRODE ARRANGEMENT FOR AN ELECTRIC FURNACE

BACKGROUND OF THE INVENTION

The invention relates to an electric furnace. Such a furnace is known for example from the French Patent Specification No. 382,457.

Advances in the development of semiconductor components in previous years have brought about increasing usage of direct current arc furnaces in the iron and steel industry for the smelting especially of electric steel.

The construction and method of operation of direct current arc furnaces are known for example from the journal "Stahl und Eisen" ("Steel and Iron"), 103 (1983) No. 3, 14th Feb. 1983, pages 133 to 137.

In the case of direct current arc furnaces, in order to optimise the electrical and thermal relationships, it has been shown to be advantageous to form the arc between one or more electrodes, arranged above the melting charge, and the melting charge itself. At least one electrode, the bottom electrode, which is in the bottom of the furnace and is in contact with the melt, is provided for the return circuit of the direct current. The bottom electrode is exposed to a continuous and very high thermal stress, for which materials having a very high fusion and melting point, for example graphite, are suitable. On the one hand, however, when carbon electrodes are used the melt is carbonised. But this is not desirable, especially during the manufacture of low-carbon steels. On the other hand, the carbon electrodes are consumed, which can weaken the furnace bottom and unfavourably affect the electrical power transmission.

The furnace according to French Patent Specification No. 382,457 consists of a combined Siemens-Martin and electric arc furnace, by which means the advantage of the Siemens-Martin furnace on the one hand—the possibility of carrying out metallurgical slag smelting—and the advantage of the electric arc furnace on the other hand—to overheat the melting bath and carry out metallurgical refining process—can be utilised simultaneously.

Moreover, several bottom electrodes are arranged in a curved furnace bottom extending in the longitudinal direction. A bath movement is brought about by the electromagnetic field of the current flowing through the melting bath from the bottom electrode to the top electrode; which bath movement is particularly intense at the melting bath contact surfaces of the bottom electrodes, where there is a marked change in the strength of the electromagnetic field, that is, at those transition points where the electric current passes over from the relatively small cross section of the bottom electrode to the relatively large cross section of the melting bath.

The melting bath flow acts on the melting bath contact surfaces which now melt back under the effect of temperature slightly behind the hearth surface, which causes small indentations, so called craters, to form. As a consequence of the relatively high kinetic energy of the bath flow, a cross flow (secondary flow) is induced in these indentations. This causes the contact surfaces to melt down still further. However, melting down of the contact surfaces of the bottom electrode at its end facing towards the melting bath is to be avoided if possible or at least reduced to a harmless level, because of craters (local cavitation) are not only restricted to the contact surfaces but also affect the adjacent areas of the refractory structural material, so that crater-like recesses develop. When the liquid charge is poured out of the furnace, the craters are then likewise emptied and hollow spaces develop which impede subsequent electrical contact of solid constituents to be melted.

The intensity of the bath movement is of course also dependent on the strength of the electromagnetic field. For a predetermined current intensity, this electromagnetic field becomes weaker the longer the magentic field lines are, that is, the greater the periphery of diameter of the bottom electrode is.

Because the forces directed towards the melting bath act at right angles to the electromagnetic field lines, a bath movement forms which is directed at right angles towards the magnetic field lines, that is, from outside towards the axis of the bottom electrode.

SUMMARY OF THE INVENTION

The invention achieves the object of providing an electric furnace of the above-mentioned type, the bottom electrode of which has a long life.

An essential characteristic of the invention is that on the one hand the hearth surface is formed in such a way that the ratio of the cross section of the hearth surface to the cross section of the bottom electrode in its melting bath contact surface is in a range which is indicated by an exponential function or, on the other hand, that the hearth surface is designed at least approximately in the shape of a truncated cone and the cone surface encloses an angle $\alpha$ of at least 20° with the melting bath contact surface.

Moreover, the most striking advantage is that, because of the continuous and successively widening transition of the current-conducting cross section from the bottom electrode into the melting bath, the electromagnetic field strength is likewise continuously changed—and not abruptly—in the interface between the bottom electrode and the melting bath. This results in a reduction of the forces causing the melting bath movement. Because the forces directed towards the melting bath act on the melting bath at right angles to the electromagnetic field lines, a bath movement is formed which is directed from the outside towards the axis of the bottom electrode. By arranging the bottom electrode(s) in a protuberance(s) of the furnace hearth, the melting bath flow, which spreads throughout the melting bath and runs radially and axially, is prevented from acting directly on the bottom electrode(s) and transferring to the latter the heat from the overheated melt. For a subsequent melting operation, moreover, it is not necessary, unlike in normal application, for the sump, which is required for an electrical contact, to cover almost the entire furnace hearth; on the contrary, merely a sump in the protuberance(s) is sufficient, with in addition a minimum amount of, example, shredder scrap being adequate to initiate the for start of the melt.

The design of the hearth surface according to the invention has the advantage that the protuberance(s) in which the bottom electrode(s) is/are located is/are adapted to the respective current passage in such a way that a minimum melting bath movement is obtained at the melting bath contact surface.

The further development of the invention subject according to the invention provides for both the metallic and the non-metallic component of the melting bath contact surface having a length, essentially in the direction of the electromagnetic field of the bottom electrode through which current has passed, which is greater than their width. By this means, during the overheating phase of the melting operation, the melting bath movement brought about by the electromagnetic forces is prevented to an even greater extent from acting directly on the metallic contact surfaces of the bottom electrode and transferring to the latter the heat from the overheated melt. The metallic component of the melting bath contact surface flows back under the effect of temperature slightly behind its adjacent non-metallic component, but it then remains stationary. In this way, two zones are formed in the melting bath contact surface; namely, the zone of the non-metallic component, which projects dam-like and only melts at high temperatures, and the zone of the electrically conducting contact surface, which zone melts back easily. This arrangement of the two components of the melting bath contact surface of the direction of the electromagnetic field thus prevents, even under an intense overheating of the melting bath, an uncontrolled melting down of the metallic part of the bottom electrode in the direction of the base of the furnace crucible. The melting-down depth of the metallic melting bath contact surface, as already mentioned, can be kept almost constant (stationary) throughout the entire melting process, because the action of the bath flow and the associated intensive heat transfer of the melting bath on the metallic contact surface through the dams of the non-metallic component and the relatively narrow width of the metallic contact surface in relation to its length are substantially reduced. Because of the narrow width of the gap, the differences in the electromagnetic field strength in the gap are small. This results in correspondingly small forces pushing the molten liquid in the gap. The temperature of the melting bath in the gap corresponds at the top to the temperature of the overheated melting bath and at the bottom, near to the contact surface, is the same as the melting temperature or slightly below it. This difference in temperature corresponds to a difference in the specific density of the liquid which is lighter at the top and heavier at the bottom. This difference in the density of the liquid in the gap counteracts movement of the molten liquid in the gap.

The metallic and the non-metallic electrode components are designed alternatively and at least partially as a hollow cylinder or in a meandering shape or as a rectangle or in the shape of a spiral, with the surface proportion of the metallic component being 10 to 70%, in particular 30 to 60%, of the entire melting bath contact surface.

A cylinder, made from a metal or non-metal, may be within the hollow-cylindrical or meandering-shaped or rectangular or spiral-shaped design of the two electrode components. The advantage arises from the fact that the life of the bottom electrode can be increased and the manufacturing costs reduced by these design measures.

The struts have the advantage that the dams of the non metallic component of the bottom electrode, when the metallic contact surface has melted back, can be mutually supported. The improved mechanical stability has a particularly favourable effect in high-performance electric arc furnaces, which have intense bath movement near to the melting bath contact surface of the bottom electrode. Staggering the struts both in the radial and the peripheral direction of the bottom electrode again increases the mechanical strengthening of the non-metallic component of the bottom electrode in its melting bath contact surface. In the case of the metallic struts, the advantage of staggering can be seen from the fact that the width of the contact surface gap can be limited in relation to the length.

The selection of the thickness ratio of the metallic to the non-metallic component of the bottom electrode in its melting bath contact surface according to the invention has the advantage that on the one hand the electrically conducting contact surfaces can be divided into narrow zones which remain largely unaffected by the melting bath flow, and on the other hand the diameter or the periphery of the bottom electrode can be specifically dimensioned for a predeterminable bath flow.

The metallic component of the bottom electrode has chemical contents preferably similar to the melting and its non-metallic component is made of a commercial, refractory structural material. This makes it possible both to produce the bottom electrode economically and operate an electric arc furnace cost-effectively.

BRIEF DESCRIPTION OF THE DRAWINGS

The invention is described in greter detail as follows with reference to illustrative embodiments shown in the drawing, wherein.

DETAILED DESCRIPTION OF THE PREFERRED EMBODIMENTS

Figure 1:
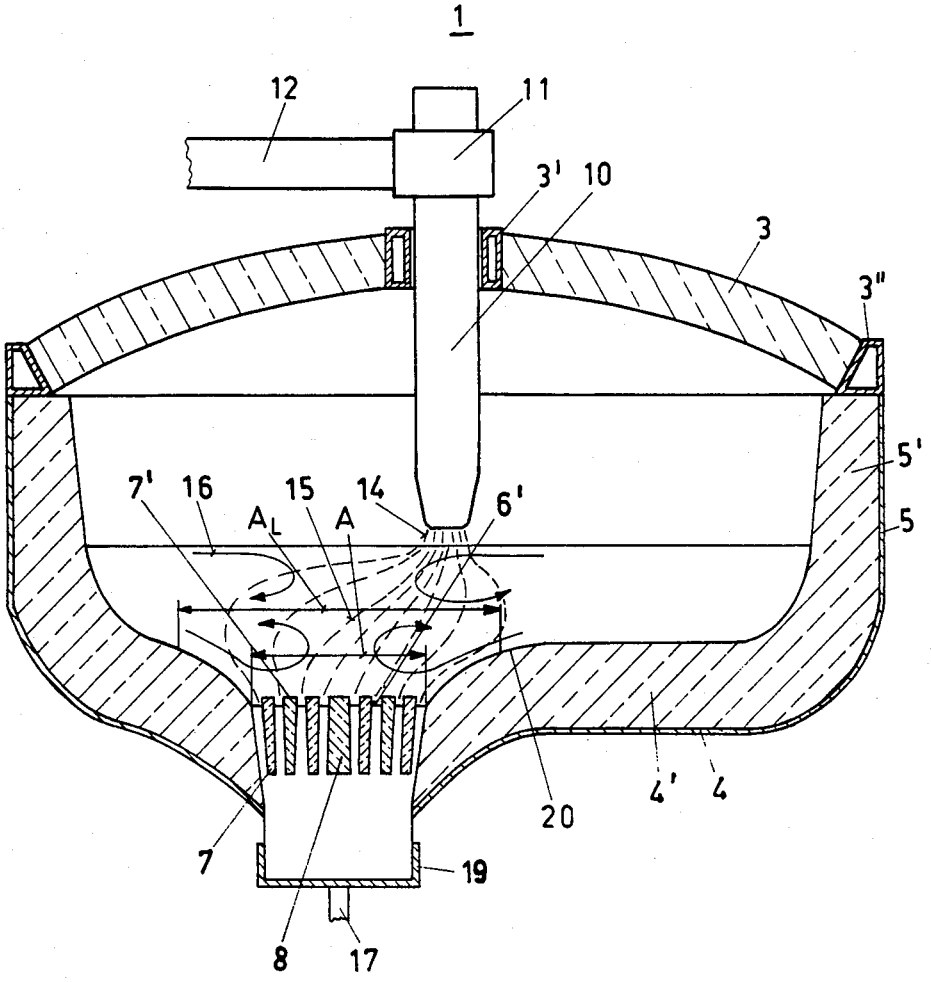
FIG. 1 is a schematic representation of a vertical section through an electric arc furnace having a bottom electrode.

FIG. 1 shows the electric arc furnace 1 with the furnace crucible 2 and furnace cover 3, with the furnace cover 3, together with the furnace cover ring 3'' being supported on the furnace crucible 2. The furnace crucible 2 consists of the crucible base 4 together with the refractory lining 4' and also of the crucible wall 5 together with the refractory lining 5'. A carbon electrode 10 is arranged above the melting bath 13, which carbon electrode 10 projects through an opening in the furnace cover 3. A cooling ring 3' is provided for cooling the electrode 10. The electrode 10 is held in a holder 11 of an electrode support arm 12. The electrode support arm 12 is connected to an electrode control device (not shown in FIG. 1).

As FIG. 1 clearly shows, the furnace crucible base 4, 4' has a protuberance which is displaced laterally to the vertical axis of the furnace, in which protuberance the bottom electrode 6 is arranged eccentrically to the carbon electrode 10.

In the exemplary embodiment according to FIG. 1 the plane hearth surface 20 in the area of the protuberance is formed in the shape of a trumpet. This produces a continuous transition from cross section A of the melting bath contact surface 6', 7' of the bottom electrode 6 to the cross section $A_L$ in the melting bath 13 at a precise distance from the melting bath contact surface 6', 7 of the bottom electrode 6. The ratio $A_L$:L will be referred to in greater detail in the description of FIG. 3. The bottom electrode 6 is held beneath the furnace crucible base by a diagrammatically depicted connecting piece 19 which is designed as a contact socket and at the same time is used for connecting the electrical current supply by the electrical connecting line 17. Non-metallic components 7, 8 of the bottom electrode 6, in its part facing towards the melting bath 13, are fitted as inserts into the bottom electrode 6 which extend about halfway into the latter in the axial direction. In the present embodiment shown in FIG. 1, they consist of three hollow-cylindrical inserts 7 and a central insert 8, by which means the metallic components 6', which are designed like an annular surface, of the melting bath contact surface 6', 7' are mutually divided from one another into narrow zones. The non-metallic components 7, 8 of the bottom electrode 6 are made from a commercial, refractory structural material, for example dolomite or magnesite.

In FIG. 1 the metallic components 6' of the bottom electrode 6 are melted back slightly, and the inserts 7, 8 protruding dam-like and projecting into the melting bath 13 can be easily recognised. The electric arc formed between the point of the top electrode 10 and the surface of the melting bath 13 is designated by the reference number 14 and the electric current lines are designated by the reference number 15. FIG. 1 shows schematically partial flow paths 16 of the melting bath movement which run symmetrically to the vertical axis of the furnace and have both an axial and a radial component. In the central area of the melting bath 13 is first of all formed on the one hand an axial upwards flow from the bottom electrode 6 towards the centre of the melting bath 13 and on the other hand an axial downwards flow from the bath surface towards the centre of the melting bath 13. The flow 16 is turned in this area and directed radially outwards towards the crucible wall 5, 5'. After repeated turning, the flow 16 again runs radially towards the inside of the furnace and passes across the inserts 7, 8 acting as dams, so that the melting bath contact surfaces 6' remain largely unaffected.

Figure 2A:
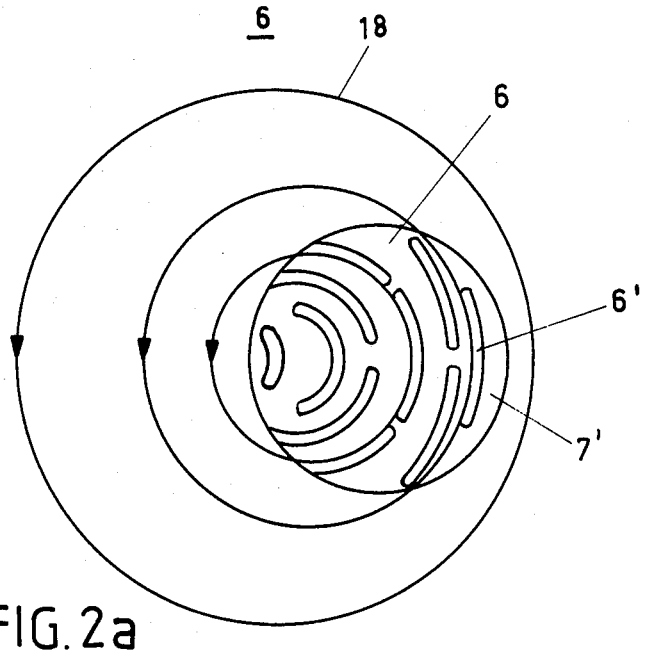
FIG. 2*a* is a schematic representation of a plan view of the bottom electrode in a non-concentric arrangement according to FIG. 2*b*.
Figure 2B:
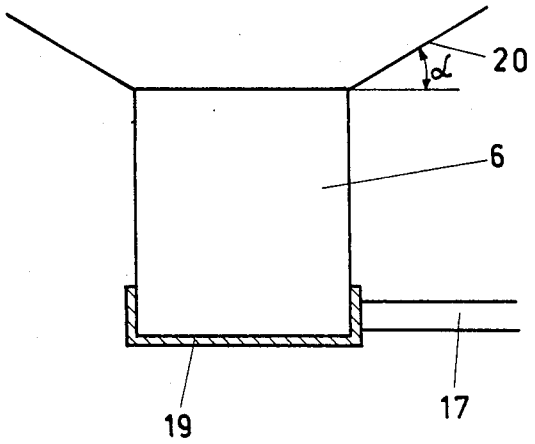
FIG. 2*b* is a schematic representation of a side view of the bottom electrode.

FIGS. 2*a* and 2*b* show an illustrative embodiment in which both the metallic component 6' and the non-metallic component 7' of the bottom electrode 6 are adapted to the path of the magnetic field line 18 which are non-concentric relative to the axis of the bottom electrode 6. This non-concentricity of the magnetic field lines 18 is brought about by the relatively high electric current which is supplied laterally to the bottom electrode by the electrical connecting line 17 via the contact socket 19. The magnetic field resulting from this then displaces the electromagnetic field in the bottom electrode 6 in the opposite direction to the electrical connecting line 17. According to FIG. 2*a*, the metallic components 6' and the non-metallic components 7' are adapted to the magnetic field. This results in an asymmetrical distribution of the components 6' and 7' relative to the axis of the bottom electrode 6', as can be seen from FIG. 2*a*.

FIG. 2*b* shows in schematic form that the hearth surface 20 has a conical design, with the angle between the hearth surface 20 and the melting bath contact surface 6', 7' being at least 20°.

Figure 3:
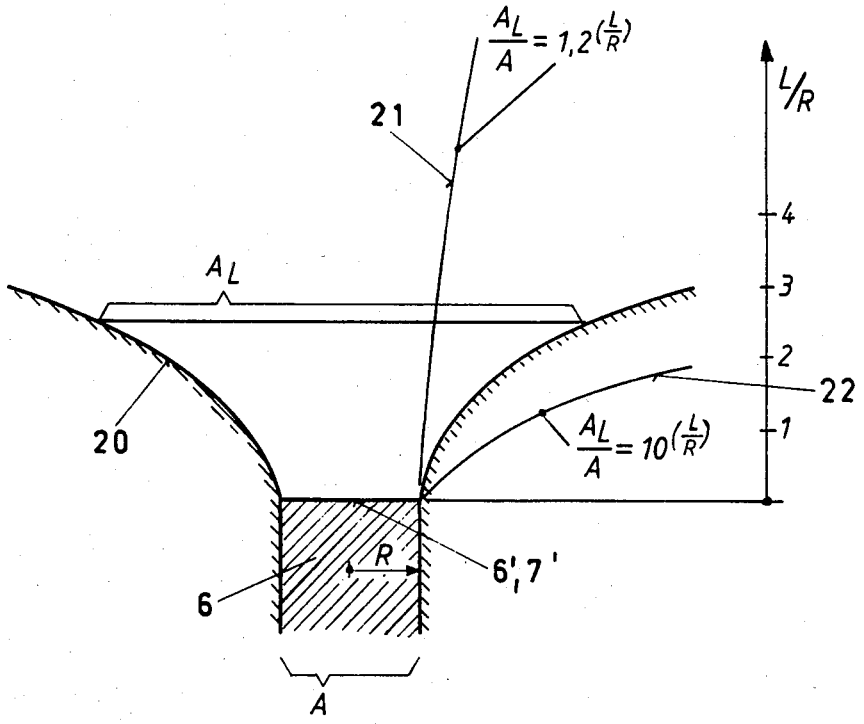
FIG. 3 is a diagram of the cross section of the bottom electrode relative to varying shape of the furnace hearth.

The diagram according to FIG. 3 shows the ratio of the cross section $A_L$ in the hearth surface 20 to the cross section A of the melting bath contact surface 6', 7' of the bottom electrode 6 at a distance L: R of the melting bath 13 from the contact surface 6', 7'. Moreover, the characteristic curve 21 designates the smallest $A_L$:A ratio for the design of the hearth surface 20 and the characteristic curve 22 designates the largest $A_L$:A ratio. That is, the hearth surface 20 is shaped in accordance with the invention within the limit values which are defined by the characteristic curves 21, 22 at a distance L: R from the melting bath contact surface 6', 7' of the bottom electrode 6, and consequently an optimum reduction in the melting bath flow 16 in the melting bath contact surface 6', 7' is achieved. The characteristic curves 21 and 22 each represent exponential functions which determine the cross section ratio $A_L$:A up to a distance from the melting bath contact surface 6', 7' into the furnace hearth 20—over the entire vertical length of the protuberance—until the furnace hearth passes into its horizontal area.

Figure 4:
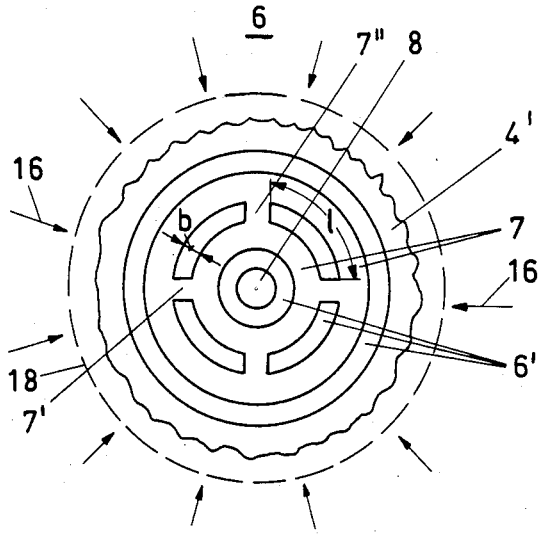
FIG. 4 is a plan view of the bottom electrode having a hollow-cylindrical arrangement of the electrode components.

FIG. 4 shows a plan view of the bottom electrode 6, which is installed into the refractory lining 4' of the furnace crucible base 4. In this illustrative embodiment, the bottom electrode 6 has an inner and an outer, in each case annular, metallic component 6' of the melting bath contact surface 6', 7' which are separated from one another by a refractory insert 7 which acts as a dam. On the other hand, the middle metallic component 6' consists of four annular sections each of which interrupt the complete annular surface by openings offset by 90°. Struts 7'' are located in these openings, which struts 7'' unite the two inserts 7 made of a refractory structural material into a mechanically solid composite. A central insert 8 made of a refractory structural material is arranged in the centre of the bottom electrode 6. The electromagnetic field lines, which run in the peripheral direction of the bottom electrode 6, are indicated by the broken line with the reference number 18. The forces which bring about the melting bath flow act at right angles to the field lines 18 and in the radial direction to the bottom electrode 6. They are schematically shown by the arrows with the reference number 16.

Figure 5:
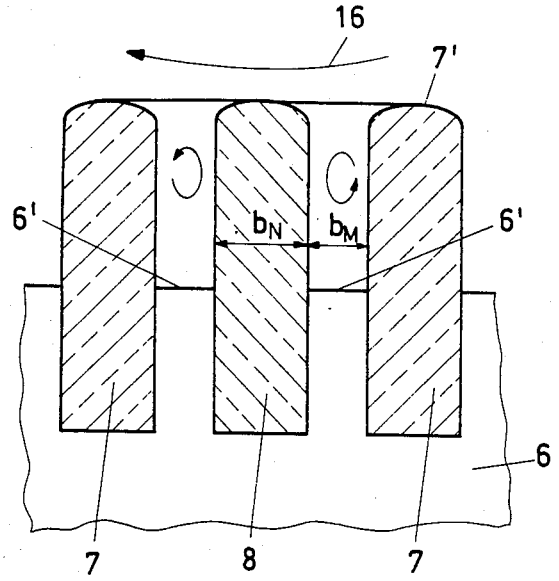
FIG. 5 is a enlarged representation of a vertical section through the bottom electrode according to FIG. 4.

FIG. 5 shows the metallic components 6' of the melting bath contact surface 6', 7' having been melted back to a considerable extent. It can clearly be seen that the melting bath movement, according to the direction of the arrow 16, passes across the inserts 7, 8 acting as dams, and the relatively narrow, annular contact surfaces 6' are not affected by the melting bath movement 16 at all. A cross flow induced by the kinetic energy of the main flow 16 only acts at the upper part of the gaps formed by the inserts 7, 8; but this cross flow does not affect the contact surface 6'. The width of the non-metallic component 7, 8 is designated by $b_N$ and that of the metallic component 6' by $b_M$.

The sectionally interrupted, hollow-cylindrical design of the dams 7 also has the advantage that, during the emptying of the melt when the electric arc furnace is tipped, liquid portions of the melt remain between the dams 7 and resolidify in this location.

If the liquid portions of the contact surfaces 6' between the dams 7, 8 were poured out when the furnace was being emptied this would be problematic for the subsequent melting operation, namely for the following reasons: the relatively brittle dams 7, 8 would be held at their part facing towards the melting bath 13 only by the struts 7'', and the metallically supporting part of the contact surfaces would become ineffective. This involves the risk of destroying the upper parts of the dams 7, 8 during the subsequent charging operation. Moreover, a perfect electrical contact between the contact surfaces 6' and the solid charged material at the start of a new melting operation would be in doubt.

It is self-evident that any number of dams 7, 8 can be arranged within the bottom electrode 6. Consequently, at a specified current intensity and with the electrically conducting part of the bottom electrode 6 which is determined by this current intensity, the periphery of diameter of the bottom electrode 6 will be increased. But the larger the periperhery of the bottom electrode 6 the longer the electromagnetic field lines 18 become and the greater the reduction in the movement of the melting bath 13 will be.

Inserting electrically non-conducting dams 7, 8 into the bottom electrode 6, for the same conducting cross section of the metallic contact surface 6', brings about on the one hand a reduction in the melting bath flow and on the other hand the contact surfaces 6' are protected from unwanted melting bath movement by the dams 7, 8. When the contact surface is melted back, a bath flow is prevented from forming in the gap because of the narrowness of the latter between two dams. Because of the narrow extent of the gap, the differences in the magnetic field strength in the gap are small. This results in correspondingly lower forces pushing the liquid. The temperature of the melt in the gap corresponds at the top to that of the overheated bath and at the bottom, near to the contact surface, is about the same as the melting temperature. This difference means a difference in the density of the liquid, which is lighter at the top and heavier at the bottom. This stratification counteracts movement (circulation) of the melt.

Figure 6A:
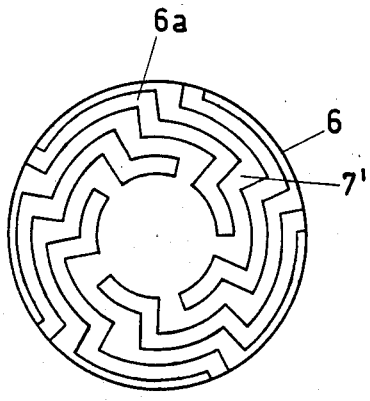
FIG. 6*a* is a plan view of the bottom electrode with a meandering shaped design of an electrode component.
Figure 6B:
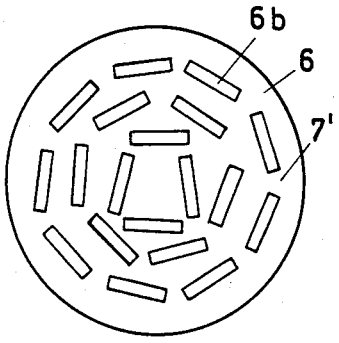
FIG. 6*b* shows a plan view of the bottom electrode with a rectangular design of an electrode component.
Figure 6C:
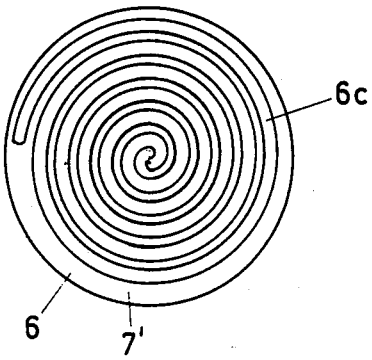
FIG. 6*c* is a plan view of the bottom electrode with a spiral-shaped design of both electrode components.

FIGS. 6*a* to 6*c* show further embodiments of the metallic component 6' of the melting bath contact surface 6', 7' of the bottom electrode 6. FIG. 6*a* shows a meandering-shaped design 6*a*, FIG. 6*b* a rectangular design 6*b* and FIG. 6*c* a spiral-shaped design 6*c* of the metallic part 6' of the melting bath contact surface 6', 7', with in each case the non-metallic, refractory components 7' being inserted in a complementary manner. In this way, the bottom electrode 6 is made into a unified whole. The components 6', 7' of the bottom electrode 6 can extend over the entire axial length of the bottom electrode 6. To always ensure the supply of electric current to the bottom electrode 6, the metallic comonent 6' of the bottom electrode 6, in the area of the electrical connecting piece 9, preferably has a compact design over its entire diameter.

The geometric design of the metallic component 6' and the non-metallic component 7' is not restricted to the illustrative embodiments shown above, and any number of geometric forms are possible.

For a given electrical connecting line of the electric arc furnace, it is important that on the one hand the cross section of the bottom electrode(s) 6 is selected to be as large as possible, and that on the other hand the electrode components 6', 7' run in the direction of the electrical field lines, wherein the length to width ratio of the electrode components 6', 7' is to be high.

The furnace crucible 4, 4', 5, 5' and likewise the furnace hearth 20 can be designed to be both rotationally symmetric and non-rotationally symmetric.

The trumpet-shaped or conical protuberances of the hearth surface 20 on the lower end of which is arranged the bottom electrode(s), can have a continuous design. However, as FIGS. 1, 2*b* and 3 show, they can just as well be formed in a discontinuous manner, that is, stepwise and be provided with shoulders. Likewise, the present invention is not only limited to cylindrically designed bottom electrodes 6. Elliptical, square, rectangular or polygonal cross section forms can also be used. Likewise, one or more bottom electrodes 6 can have a hollow-cylindrical design or at least a partially hollow-cylindrical design. Moreover, it is self-evident that any number of bottom electrodes 6 can be built into the furnace crucible base 4, 4', and in fact at any location in the furnace crucible base 4,4'.

Obviously, numerous modifications and variations of the present invention are possible in light of the above teachings. It is therefore to be understood that within the scope of the appended claims, the invention may be practiced otherwise than as specifically described herein.

I claim:

1. A direct current electric arc furnace for melting metals, comprising:

a furnace crucible having a base including a hearth surface;

a top electrode;

a bottom electrode having a top surface extending into said crucible through said hearth surface; and means for forming an arc between said top and bottom electrodes, wherein said top surface of said bottom electrode comprises at least one metallic component and at least one non-metallic component, whereby the erosion of said metallic component by a flow of said molten metal is retarded, and wherein:

$$1.2(L/R) \leqq (AL/A) \leqq 10(L/R)$$

where A is the cross-section area in $m^2$ of the bottom electrode at said top surface, AL is the cross-section area of said hearth surface in $m^2$, L is the axial distance in m from said top surface, and R is the radius in m of said bottom electrode at said top surface.

2. The furnace of claim 1, wherein said electric arc forms an electromagnetic field around said bottom electrode and wherein said metallic and non-metallic components are elongate with lengths parallel to said electromagnetic field which are greater than widths thereof transverse to said field.

3. The furnace of claim 2, wherein said metallic and non-metallic components are mutually concentric about the vertical axis of said bottom electrode.

4. The furnace of claim 2, wherein said magnetic and non-magnetic components are cylindrical.

5. The furnace of claim 2, wherein said magnetic and non-magnetic components are spiral.

6. The furnace of claim 2, wherein one of said magnetic and non-magnetic components are rectangular.

7. The furnace of claim 2, wherein said magnetic and non-magnetic components are meandering-shaped.

8. The furnace of claim 1 wherein said metallic component comprises between 10% and 70% of said top surface of said bottom electrode.

9. The furnace of claim 1 including struts mechanically connecting adjacent ones of said non-metallic electrode components.

10. The furnace of claim 2 wherein a ratio of said width of said metallic component to said width of said non-metallic component is between 1:1 and 1:5 at said top surface.

11. The furnace of claim 1 wherein said non-metallic component is formed of a refractory material having an electrical conductivity less than that of the metallic component and a melting point higher than that of the metallic component.

* * * * *